United States Patent [19]

Oyama

[11] 4,138,774

[45] Feb. 13, 1979

[54] PANEL POSITIONING APPARATUS

[75] Inventor: Tadao Oyama, Mobara, Japan

[73] Assignee: Hitachi, Ltd., Japan

[21] Appl. No.: 787,842

[22] Filed: Apr. 15, 1977

[30] Foreign Application Priority Data

| | | | |
|---|---|---|---|
| Jul. 28, 1976 | [JP] | Japan | 51-89099 |
| Jul. 28, 1976 | [JP] | Japan | 51-89098 |
| Aug. 11, 1976 | [JP] | Japan | 51-94897 |

[51] Int. Cl.[2] ..... H01J 9/06

[52] U.S. Cl. ..... 29/25.19; 29/281.1

[58] Field of Search ..... 29/281.1, 281.2, 281.4, 29/281.5, 25.19, 25.2; 269/321 T, 296

[56] References Cited

U.S. PATENT DOCUMENTS

| | | | |
|---|---|---|---|
| 3,284,884 | 11/1966 | Prazak | 269/321 T |
| 3,899,812 | 8/1975 | Baranski et al. | 29/25.19 |

*Primary Examiner*—James L. Jones, Jr.

*Attorney, Agent, or Firm*—Craig & Antonelli

[57] ABSTRACT

Apparatus for accurately positioning a panel, which has been brought to a position near to its correct position, by using, as a reference, panel pins projecting from inner lateral surfaces of the panel in a process for manufacturing color picture tubes. The apparatus includes substantially horizontal support means for movably supporting the panel thereon, and a plurality of positioning units each having a positioning lever formed therein with a guide groove adapted to engage one of the panel pins of the panel placed on the support means for positioning the panel in a predetermined position on the support means. The apparatus also includes a panel holding device effective to hold the panel pins of the panel positioned in the predetermined position on the support means so as to move the panel upwardly to a predetermined height, thereby effecting positioning of the panel in a vertical direction.

Combined with a mask holder for holding a shadowmask and moving the same upwardly to a predetermined position, the positioning apparatus is capable of functioning as apparatus for mounting the shadowmask in the panel.

17 Claims, 10 Drawing Figures

PANEL POSITIONING APPARATUS

This invention relates to apparatus for accurately positioning a panel in a predetermined position in a process for manufacturing color picture tubes.

Generally, in a process for manufacturing color picture tubes, a panel is arranged in a predetermined position and various process steps are repeatedly followed for working on the panel and attaching and detaching various parts to and from the panel. In positioning the panel in the predetermined position, it is essential to effect positioning in such a manner that panel pins attached to inner lateral surfaces of the panel for mounting a shadowmask in the panel are used as a reference and such panel pins are correctly positioned in predetermined positions at least in a horizontal plane. Additionally, in some cases, it is necessary to effect positioning of the panel pins also in a vertical direction. Heretofore, a problem has been encountered in accurately positioning the panel. Variations in the material of the panels and handling thereof in the step for producing the same result in variations in the shape and dimensions of the panel. It is thus impossible to automatically effect accurate positioning of such panels by using the panel pins as a reference. The present practice is to rely on manual operation in carrying out positioning of the panels.

Also, in a process for manufacturing color picture tubes, it is necessary to perform the operations of applying layer of phosphor-containing photosensitive material on a glass screen and exposing selected areas of the layer to a controlled light source for permanently affixing a repetitive pattern of red, green and blue light-emitting phosphor dots to the glass screen. This makes it necessary to mount a shadowmask in the panel each time such operation is performed. It has hitherto been customary to rely on manual operation in mounting a shadowmask in the panel.

As aforesaid, the present practice in the production of color picture tubes includes process steps which require a lot of manual operation. This has resulted in very low production efficiency in the manufacture of color picture tubes and has hampered realization of advantages from use of automatically-operated, labor-saving apparatus in the manufacture of color picture tubes.

Accordingly, an object of the present invention is to provide an apparatus for accurately positioning a panel, which has been placed in a position near to its correct position on substantially horizontal support means, on such support means by using, as a reference, panel pins attached to inner lateral surfaces of the panel.

Another object of the present invention is to provide a positioning apparatus comprising a plurality of positioning units each including a positioning lever located in a position corresponding to one of the panel pins of a panel placed on substantially horizontal support means, such positioning lever being formed with a groove for guiding the respective panel pin of the panel to a predetermined position as such positioning lever is moved.

Another object of the present invention is to provide a panel positioning apparatus further comprising a panel holding device which is capable of effecting positioning of a panel, which has been accurately positioned in a predetermined position on support means, in a vertical direction by holding panel pins of the panel.

Still another object of the present invention is to provide an apparatus for mounting a shadowmask in a panel placed on substantially horizontal support means.

Still another object of the present invention is to provide an apparatus for first accurately positioning a panel on substantially horizontal support means by using, as a reference, panel pins of the panel which has been placed near to its correct position on the support means, and then mounting a shadowmask in the panel.

A further object of the present invention is to provide an apparatus for first accurately positioning a panel on a substantially horizontal support means by using, as a reference, panel pins of the panel which has been placed near to its correct position on such support means, then positioning the panel in a vertical direction, and finally mounting a shadowmask in the panel which has been positioned in a predetermined position.

Additional and other objects and advantages of the invention will become evident from the description set forth whereinafter when considered in conjunction with the accompanying drawings.

FIG. 1 to FIG. 9 show a panel positioning apparatus according to the invention and a shadowmask mounting apparatus utilizing the panel positioning apparatus for mounting a shadowmask in a panel. It is to be understood that the panel positioning apparatus according to the invention is not limited in its use to the application in which, as shown and described in the embodiment, it is utilized for constituting a shadowmask mounting apparatus.

Figure 8:
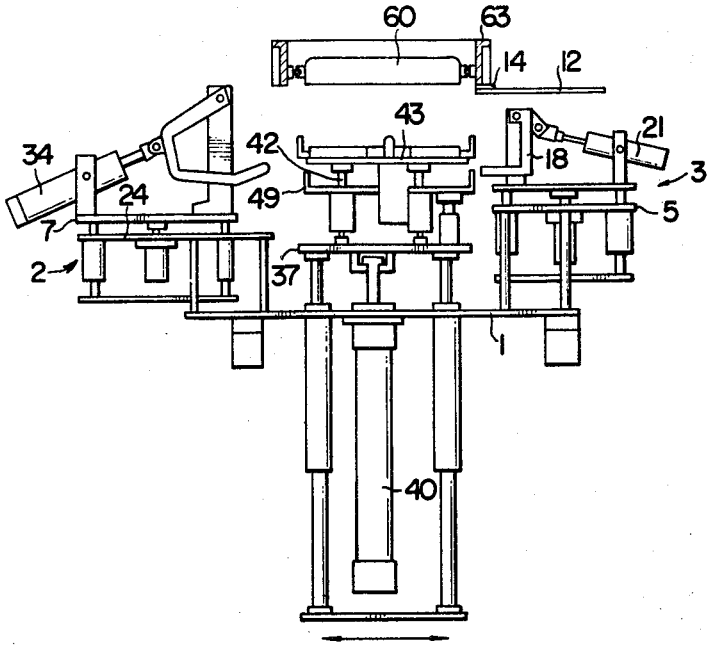
FIG. 8 is a view similar to FIG. 3 but showing a dummy panel being placed on panel rests.
Figure 9:
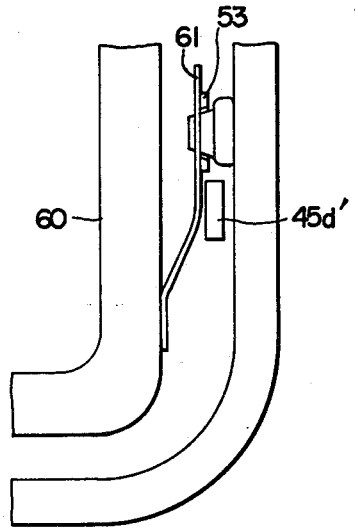
FIG. 9 is a fragmentary sectional plan view showing one of the plate springs of a shadowmask being in engagement with one of the panel pins of a panel.
Figure 10:
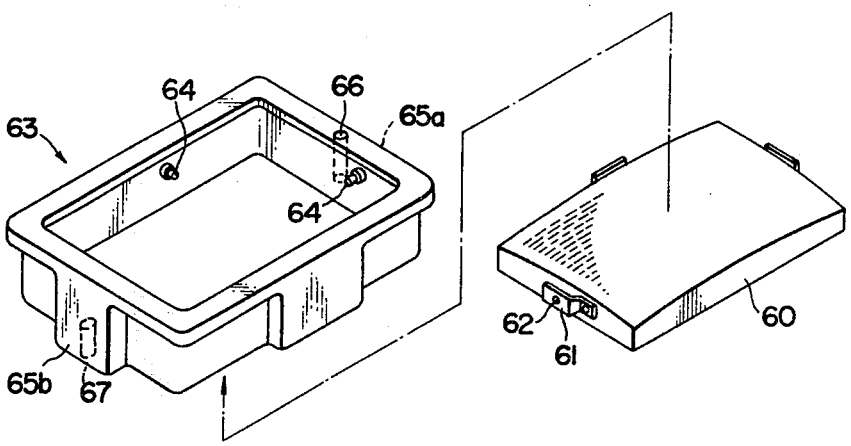
FIG. 10 is a perspective view of a shadowmask and a dummy panel for holding the shadowmask.

Before describing in detail the shadowmask mounting apparatus shown in FIG. 1 to FIG. 9, a shadowmask handled in the aforesaid apparatus and a dummy panel used for conveying the shadowmask will be outlined. Referring to FIG. 10, the shadowmask 60 which is substantially rectangular in shape has attached to three sides thereof plate springs 61, each of which is secured at one end thereof to one of the sides of the shadowmask 60 and free at the other end thereof, with an aperture 62 being formed in each plate spring 61 in the vicinity of its free end. The apertures 62 are each adapted to receive therein one of pins attached to inner lateral surfaces of a panel (not shown) when the shadowmask 60 is mounted and held in the panel.

Figure 1:
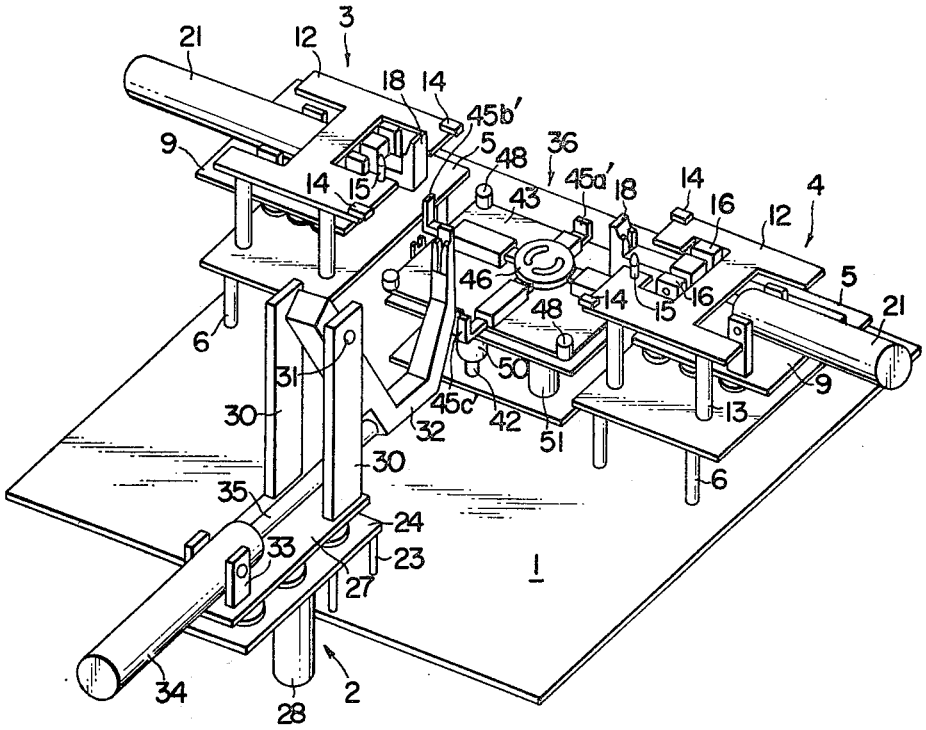
FIG. 1 is a perspective view of the apparatus comprising one embodiment of the present invention.

The shadowmask 60 is temporarily supported in a shadowmask housing jig 63 which is in the form of a rectangular frame and generally referred to as a dummy panel, when it is supplied to the apparatus shown in FIG. 1. The dummy panel 63 has attached to its inner lateral surfaces pins 64, as is the case with a panel, which each correspond in position to one of the apertures 62 formed in the plate springs 61 attached to the shadowmask 60, so that the shadowmask 60 is supported in the dummy panel 63 through the agency of the pins 64 and the plate springs 61. The dummy panel 63 is formed on outer surfaces of opposing short side walls with protuberances 65*a* and 65*b*, one protuberance 65*a* being formed therein with a circular reference hole 66 while the other protuberance 65*b* being formed therein with a slot 67. The reference hole 66 and the slot 67 are used for positioning the dummy panel 63.

Figure 2:
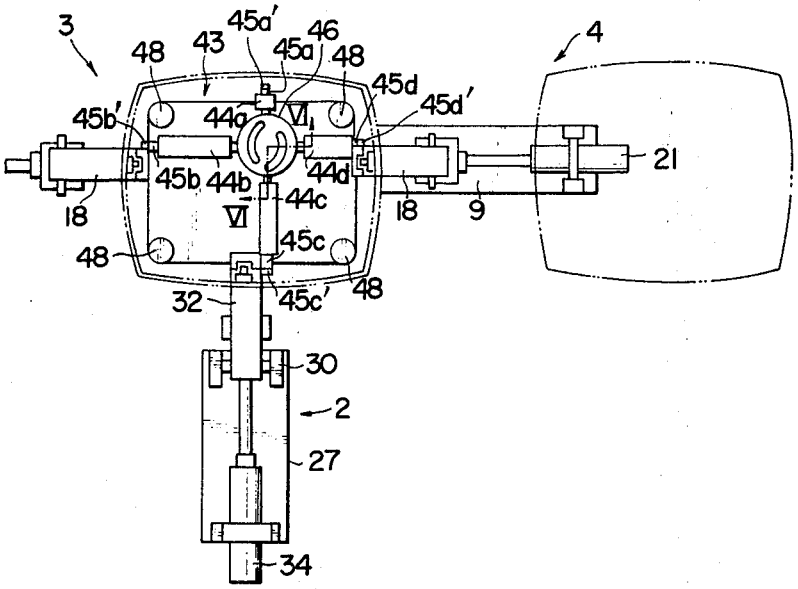
FIG. 2 is a plan view, with certain parts being omitted, of the apparatus shown in FIG. 1.
Figure 3:
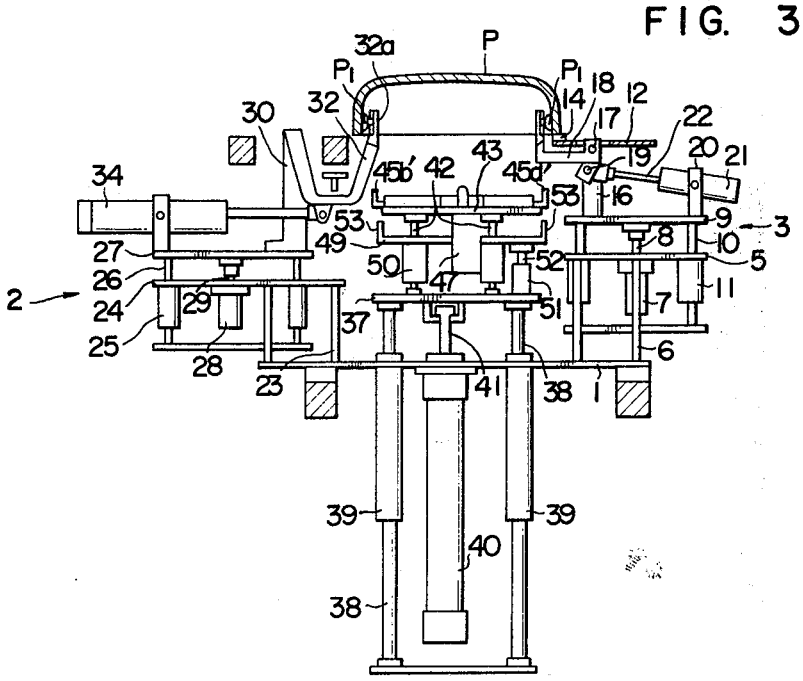
FIG. 3 is an exploded side view of the apparatus shown in FIG. 1, with the right half of the figure showing the positioning unit 4 in a side view and the left half of the figure showing the positioning unit 2 in a side view.

Referring to FIGS. 1 to 3, the numeral 1 designates a base secured to a frame (not shown) and supporting thereon three positioning units 2, 3 and 4. The two positioning units 3 and 4 are disposed in face-to-face relation and spaced apart from each other a predetermined distance. Since the units 3 and 4 are of a mirror image structure, like reference characters designate similar parts in the two units. The positioning unit 2 is located such that it is at a right angle to the other units 3 and 4.

The positioning unit 3 comprises a horizontal support plate 5, and columns 6 secured to the base 1 and supporting the support plate 5. Secured to the underside of the support plate 5 is a pneumatic cylinder 7 which receives therein a piston rod 8 extending upwardly through the support plate 5 and connected at its forward end to the underside of an elevatory plate 9. The elevatory plate 9 is supported by a plurality of guide rods 10 which are each slidably supported by one of sleeves 11 secured to the underside of the support plate 5. Thus, actuation of the pneumatic cylinder 7 vertically moves the elevatory plate 9.

As is best shown in FIG. 1, a panel rest 12 is disposed above the elevatory plate 9 and secured to the support plate 5 through columns 13, so that the panel rest 12 is stationary. Pads 14 made of resilient material, such as rubber, are located on corners of the opposing end edges of the panel rests 12 of the positioning units 3 and 4, and a guide pin 15 is attached in a position on each end edge of the panel rests 12 which is midway between the two pads 14. The guide pins 15 are adapted to be inserted in the reference hole 66 and the slot 67 respectively of the dummy panel 63 shown in FIG. 10 when the latter is placed on the pads 14, so that the guide pins 15 perform the function of positioning the dummy panel 63 in a predetermined position. The pads 14 are located such that they correspond in position to four corners of a panel P or dummy panel 63 when the latter is placed on the former, and each pad 14 has a horizontal support surface for supporting the underside of each of the four corners of the panel P or dummy panel 63.

Attached to the surface of the elevatory plate 9 is a pair of posts 16 which supports, through a pin 17, one end of an L-shaped positioning lever 18. A tiny arm 19 is provided in the vicinity of one end of the positioning lever 18 (See FIG. 3). Another pair of posts 20 is disposed parallel to the pair of posts 16 and pivotally supports a pneumatic cylinder 21 which receives therein a piston rod 22 connected at its forward end to the arm 19 of the positioning lever 18. Actuation of the pneumatic cylinder 21 causes the positioning lever 18 to move in pivotal motion about the pin 17.

Figure 4:
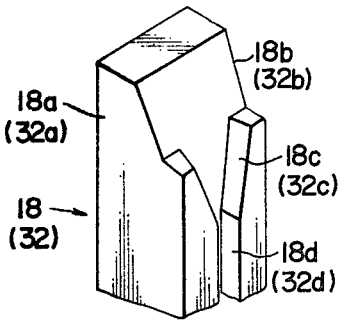
FIG. 4 is a perspective view, shown on an enlarged scale, of the forward end of a positioning lever.
Figure 5:
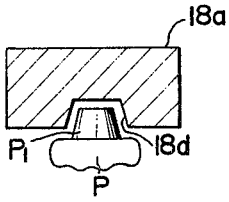
FIG. 5 is a sectional view of a positioning lever showing the manner in which one of the guide pins of a panel is guided by the guide groove **18*d*** of the positioning lever.

The positioning lever 18 is formed, in a rectilinear portion 18*a* adjacent the free end of the positioning lever 18, with a tapering surface 18*b* as shown on an enlarged scale in FIG. 4. Continuous with the tapering surface 18*b* is an introducing groove portion 18*c* of the V-shape which is continuous with a guide groove portion 18*d*. The guide groove portion 18*d*, which functions to guide the forward end of one of panel pins $P_1$ attached to inner lateral surfaces of the panel P, has a width which is slightly greater than the width of the panel pin $P_1$ as shown in FIG. 5. The position and the stroke of the pneumatic cylinder 21 are such that the positioning lever 18 moves between one position in which the rectilinear portion 18*a* having the guide groove portion 18*d* is disposed vertically as shown in FIG. 3 and the other position in which the rectilinear portion 18*a* is disposed horizontally as shown in FIG. 8. Also, the positioning lever 18 is positioned such that, when the lever 18 moves upwardly together with the elevatory plate 9 with the rectilinear portion 18*a* of the lever 18 being disposed vertically as shown in FIG. 3, the guide groove portion 18*d* guides the corresponding panel pin $P_1$ of the panel P to a predetermined position. A suitable stopper may be provided so as to positively cause the positioning lever 18 to stop after the rectilinear portion 18*a* thereof having the guide groove 18*d* has moved to its vertical position.

The panel rest 12 which remains stationary is partially cut out so as to avoid collision of the posts 16, 20, positioning lever 18 and pneumatic cylinder 21 with one another when the elevatory plate 9 is moved.

Like the positioning units 3, 4, the positioning unit 2 comprises a support plate 24 secured to the base 1 through columns 23, sleeves 25 secured to the support plate 24, guide rods 26 each slidably supported by one of the sleeves 25, an elevatory plate 27 secured to upper ends of the guide rods 26, and a pneumatic cylinder 28 secured to the underside of the support plate 24 and receiving therein a piston rod 29 extending through the support plate 24 and connected at its forward end to the underside of the elevatory plate 27. Mounted on the elevatory plate 27 are a pair of posts 30, a positioning lever 32 pivotally supported by the pair of posts 30 through a pin 31, a pair of posts 33, and a pneumatic cylinder 34 pivotally supported by the pair of posts 33 and receiving therein a piston rod 35 connected at its forward end to the positioning lever 32. The positioning lever 32 has adjacent its free end a rectilinear portion 32*a* which is formed, as shown in FIG. 4, with a tapering surface 32*b*, an introducing groove portion of the V-shape 32*c* and a guide groove portion 32*d* as is the case with the positioning lever 18. The positioning lever 32, which is substantially in the form of a letter U to avoid its collision with the frame of the apparatus, can move between one position in which the rectilinear portion 32*a* is disposed vertically and the other position in which it is disposed horizontally (See FIG. 8), as is the case with the positioning lever 18 in the form of a letter L.

Arranged in a space surrounded by the three positioning units 2, 3 and 4 is a panel and mask holding unit 36 which comprises an elevatory plate 37 having connected to its underside a plurality of guide rods 38 each slidably supported by one of sleeves 39 secured to the base 1. Secured to the underside of the base 1 is a pneumatic cylinder 40 which receives therein a piston rod 41 extending upwardly through the base 1 and connected at its forward end to the underside of the elevatory plate 37. Thus, actuation of the pneumatic cylinder 40 causes the elevatory plate 37 to move in a vertical direction.

Figure 6:
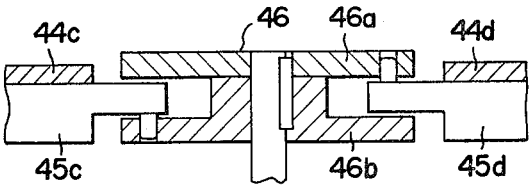
FIG. 6 is a sectional view taken along the line VI—VI of FIG. 2.

The elevatory plate 37 has secured to its upper surface a plurality of upstanding guide rods 42 which mount at their upper ends a mask holder 43 having mounted on its surface four guides 44*a*, 44*b*, 44*c* and 44*d* as shown in FIG. 2, the guides 44*a*, 44*b*, 44*c* and 44*d* supporting sliders 45*a*, 45*b*, 45*c* and 45*d* respectively for sliding motion. The sliders 45*a* and 45*c* are adapted to move in a direction which is parallel to the plane in which the positioning lever 32 of the positioning unit 2 moves, while the sliders 45*b* and 45*d* are adapted to move in a direction at a right angle to such plane. The sliders 45*a*, 45*b*, 45*c* and 45*d* each engage at one end thereof a grooved cam 46 in the form of a disk, so that rotation of the grooved cam 46 causes the sliders to move in sliding motion. As shown in FIG. 6, the grooved cam 46 includes two cam disks 46*a* and 46*b*, with the sliders 45*b* and 45*d* being in engagement with grooves formed in the upper cam disk 46*a* and the sliders 45*a* and 45*c* being in engagement with grooves formed in the lower cam disk 46*b*. The sliders 45*a*, 45*b*, 45*c* and 45*d* are formed at the other end thereof with upright pawls 45*a*', 45*b*', 45*c*' and 45*d*' respectively. The pawl 45*a*' is adapted to come into engagement with a side surface of the shadowmask 60 which has no plate spring 61 attached thereto, while the rest of the pawls 45*b*', 45*c*' and 45*d*' are adapted to come into engagement with the plate springs 61 at the other side surfaces of the shadowmask 50 and cause them to deflect toward the side surfaces of the shadowmask 60. It is to be understood that the pawl 45*a*' is not limited to the form which is small in width as shown, and that the pawl 45*a*' may have a large width. The cam grooves of the grooved cam 46 are shaped and configured such that, when the grooved cam 46 rotates in one direction, all the pawls move away from one another simultaneously or with a time lag, and when it rotates in the reverse direction, all the pawls move toward each other. The grooved cam 46 is driven by a torque actuator 47 secured to the underside of the mask holder 43.

As can be seen in FIGS. 1 and 2, the mask holder 43 has frame guides 48 made of rubber or other resilient material and mounted on four corners of the upper surface thereof.

Figure 7:
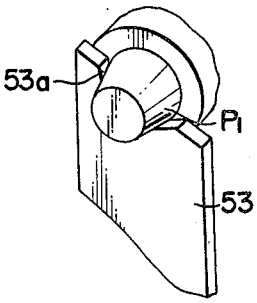
FIG. 7 is a perspective view showing one of the panel pins being held in position by one of the positioning upright portions of a panel holding plate.

Arranged between the mask holder 43 and the elevatory plate 37 is a panel holding plate 49 which has secured to its underside sleeves 50 each slidable along a guide rod 42, and which is secured to an upper end of a piston rod 52 received in a pneumatic cylinder 51 secured to the upper surface of the elevatory plate 37. Thus, actuation of the pneumatic cylinder 51 causes the panel holding plate 49 to move in a vertical direction. The panel holding plate 49 is formed at its outer peripheral edge with three positioning upright portions 53 which are disposed in three positions corresponding to those of the panel pins $P_1$ of the panel P. The positioning upright portions 53 are each formed, as shown in FIG. 7, at the upper end thereof with a U-shaped notch 53*a* for receiving one of the panel pins $P_1$. The U-shaped notches 53*a* correspond in position to the guide groove portions 18*d*, 32*d* of the positioning levers 18, 32 in FIG. 2. Thus, if the panel holding plate 49 is moved upwardly, the U-shaped notches 53*a* formed in the positioning upright portions 53 receive therein the panel pins $P_1$ of the panel P resting on the pads 14 and positioned accurately by the positioning levers 18, 32, thereby holding the panel P. The panel holding plate 49 is adapted to move between a predtermined position in which the panel holding plate 49 is in close proximity to the mask holder 43 (when the panel holding plate 49 is in this position, positioning upright portions 53 extend beyond the mask holder 43 and the panel P held by the positioning upright portions 53 and the shadowmask 60 held by the mask holder 43) and a position in which the panel holding plate 49 is moved away from the mask holder 43 (when the panel holding plate 49 is in this position, the positioning upright portions 53 are disposed below the upper surface of the mask holder 43).

All the pneumatic cylinders and the torque actuator are connected to a control device (not shown) and automatically actuated in sequence as subsequently to be described. Such control device is known and can be readily designed by one of ordinary skill in the art, so that detailed description thereof will be omitted.

Operation of the embodiment of the invention constructed as aforesaid will now be described. As shown in FIG. 8, the positioning levers 18, 32 are brought to the lower limits of their pivotal movements, and the support plates 5, 27 and the elevatory plate 37 are brought to their lowermost positions. In this condition, the dummy panel 63 temporarily supporting the shadowmask 60 therein is placed on the pads 14 on the panel rests 12, with the guide pins 15 extending vertically from the panel rests 12 being received in the reference hole 66 and the slots 67 respectively in the protuberances 65 formed on the outer surfaces of opposing short side walls of the dummy panel 63. Since the dummy panel 63 is accurately positioned by means of the guide pins 15, reference hole 66 and slot 67, the shadowmask 60 supported in the dummy panel 63 is also accurately positioned. At this time, the pawls 45*a*', 45*b*', 45*c*' and 45*d*' of the sliders 45*a*, 45*b*, 45*c* and 45*d* respectively on the mask holder 43 are located in positions in which they are moved outwardly away from one another.

Then, actuation of the pneumatic cylinder 40 causes the elevatory plate 37 and the mask holder 43 to move upwardly, with the result that the pawls 45*a*', 45*b*', 45*c*' and 45*d*' are each inserted between one of the inner side wall surfaces of the dummy panel 63 and one of the plate springs 61 attached to the side surfaces of the shadowmask 60. Thereafter, actuation of the torque actuator 47 causes the grooved cam 46 to rotate, thereby moving the pawls 45*a*', 45*b*', 45*c*' and 45*d*' toward one another. This causes the plate springs 61 to be deflected to press against the side surfaces of the shadowmask 60 and releases the same from engagement with pins 64 of the dummy panel 63. Finally, the pneumatic cylinder 40 is actuated again to move the elevatory plate 37 downwardly while the mask holder 43 supports the shadowmask 60 thereon. The dummy panel 63 is removed from the panel rests 12, 12 by a conveyor device (not shown).

The aforementioned series of operation steps are performed preliminary to mount of the shadowmask 60 in the panel P.

Then, the panel P is conveyed by a conveyor device (not shown) and placed in a position near to its correct position on the pads 14 of the panel rests 12, 12 as shown in FIGS. 2 and 3. The conveyor device used is of a known type and detailed description thereof is therefore omitted. After the panel P is placed on the pads 14, the pneumatic cylinders 21 and 34 of the positioning units 2, 3 and 4 are actuated to bring the positioning levers 18 and 32 to positions in which the guide groove portions 18*d*, 32*d* thereof are disposed vertically. Thereafter, the pneumatic cylinders 7 and 28 of the positioning units 2, 3 and 4 are actuated to move the elevatory plates 9 and 27 upwardly. As the elevatory plates 9 and 27 move upwardly, the rectilinear portions 18*a* and 32*a* at the forward end of the positioning levers 18 and 32 also move upwardly and enter the inner hollow space of the panel P, so that the panel pins $P_1$ are introduced into the guide groove portions 18*d* and 32*d* through the introducing groove portions 18*c* and 32*c* of the positioning levers 18 and 32. In this way, the panel P is accurately positioned on the pads 14 in a position which is determined by the guide groove portions 18*d* and 32*d* with the panel pins $P_1$ serving as a reference. Following the positioning of the panel P, the pneumatic cylinders 7, 21, 28 and 34 are actuated to bring the positioning levers 18 and 32 and the elevatory plates 9 and 27 to their original positions (shown in FIG. 8).

Then, the pneumatic cylinder 51 of the panel and mask holding unit 36 is actuated to move the panel holding plate 49 upwardly to a position in which it is in close proximity to the mask holder 43 holding the shadowmask 60 thereon. In this position, the positioning upright portions 53 of the panel holding plate 49 are disposed alongside of the pawls 45*a*', 45*b*', 45*c*' and 45*d*' on the mask holder 43. At this time, the pneumatic cylinder 40 is actuated to move the elevatory plate 37 upwardly along with the mask holder 43 and the panel holding plate 49, with the result that the shadowmask 60 held by the mask holder 43 is introduced into the panel P. At the same time, the panel P is held by the panel holding plate 49 as the panel pins $P_1$ are each received in one of the U-shaped notches 53*a* formed at the upper end of the positioning upright portions 53 of the panel holding plate 49. In this state, the panel P is accurately positioned both horizontally and vertically with respect to the shadowmask 60. Thereafter, the torque actuator 47 is actuated to move the pawls 45*a*', 45*b*', 45*c*' and 45*d*' away from one another outwardly and release the plate springs 61 of the shadowmask 60 from engagement therewith. This allows the plate springs 61 to be displaced outwardly and permits each of the panel pins $P_1$ of the panel P to be received in one of the apertures 62 in the plate springs 61 as shown in FIG. 9. Thus, the shadowmask 60 is mounted in the panel P. After the shadowmask 60 is mounted in the panel P, the pneumatic cylinders 40 and 51 are actuated again to move the elevatory plate 37 and the panel holding plate 49 to their original positions. The panel P having the shadowmask 60 mounted therein is moved to the next processing station by a conveyor device (not shown). This completes one cycle of operation steps for mounting a shadowmask in a panel, and this cycle is repeated again.

In the embodiment shown and described hereinabove, the panel holding plate 49 is used to ensure that the shadowmask 60 held by the mask holder 43 is located correctly relative to the panel P in a vertical direction. However, the use of the panel holding plate 49 is not essential and the plate 49 may be done without. If this is the case, it is necessary to move the mask holder 43 upwardly to a predetermined vertical position relative to the panel P held by the pads 14.

While the described embodiment represents the preferred form of the present invention, it is to be understood that modification will occur to those skilled in the art without departing from the spirit of the invention, the scope of the invention is therefore to be determined solely by the appended claims.

I claim:

1. Apparatus for positioning a panel by using, as a reference, a pair of panel pins attached to inner lateral surfaces of the panel, said lateral surfaces being in spaced justaposed positions, comprising:

support means having a substantially horizontal support surface for movably supporting said panel;

a plurality of positioning units corresponding in number and position to said panel pins, each of said positioning units comprising a positioning lever formed therein with a groove for guiding one of said panel pins to a predetermined position as said positioning lever is actuated while said panel is supported on said supported surface of said support means, and panel holding means located between said positioning units, said panel holding means including a panel holding plate movable in a substantially vertical direction, means for moving said panel holding plate in a substantially vertical direction, upright positioning portions provided on said panel holding plate and each formed at an upper end thereof with a notch for receiving and supporting one of said panel pins.

2. Apparatus as claimed in claim 1, wherein each of said notches of said upright positioning members is located at a position whereupon upward movement of said panel holding plate can receive the associated panel pin of said panel which has been accurately positioned on said support surface.

3. Apparatus as claimed in claim 2, wherein said groove of said positioning lever comprises an introducing groove portion open at one end and increasingly reduced in width in going toward the other end thereof, and a guide groove portion of a constant width continuous with the other end of said introducing groove portion.

4. Apparatus as claimed in claim 3, wherein each of said positioning units further comprises an elevatory plate supporting said positioning lever and movable in a substantially vertical direction, and means for moving said elevatory plate.

5. Apparatus as claimed in claim 4, wherein each said positioning lever comprises a rectilinear portion formed with said groove in close proximity to one end thereof and is pivotally supported on said elevatory plate, said positioning lever being capable of movement between a position in which said rectilinear portion is disposed substantially vertically beneath the corresponding panel pin of the panel held by said support means and a position in which said rectilinear portion is disposed away from beneath said panel.

6. Apparatus as claimed in claim 5, wherein each said positioning unit further comprises means located on said elevatory plate for moving said positioning lever in pivotal motion.

7. Apparatus as claimed in claim 1, wherein said panel has a third panel pin attached to an inner lateral surface of the panel interposed between the pair of inner lateral surfaces each having one of said pair of panel pins attached thereto, and said apparatus further comprises another positioning unit provided to handle said third pin and including a positioning lever formed with a groove for guiding said third panel pin to a predetermined position as said positioning lever is actuated while said panel is held by said support means.

8. Apparatus as claimed in claim 7, wherein said groove of said positioning lever comprises an introducing groove portion open at one end and increasingly reduced in width in going toward the other end thereof, and a guide groove portion of a constant width contiguous with the other end of said introducing groove portion.

9. Apparatus as claimed in claim 8, wherein said positioning unit further comprises an elevatory plate supporting said positioning lever and movable in a susbstantially vertical direction, and means for moving said elevatory plate.

10. Apparatus as claimed in claim 9, wherein said positioning lever comprises a rectilinear portion formed with said groove in close proximity to one end thereof and is pivotally supported on said elevatory plate, said positioning lever being capable of movement between a position in which said rectilinear portion is disposed substantially vertically beneath the corresponding panel pin of the panel held by said support means and a position in which said rectilinear portion is disposed away from beneath said panel.

11. Apparatus as claimed in claim 10, wherein said positioning unit further comprises means located on said elevatory plate for moving said positioning lever in pivotal motion.

12. Apparatus according to claim 1, wherein said panel holding means constitutes means for locating said panel in a predetermined vertical position relative to a shadow mask having plate springs attached to lateral surfaces thereof corresponding to said panel pins, each of said springs being formed with an aperture for receiving one of the panel pins, and wherein said apparatus further comprises support means for holding the shadowmask, said shadowmask holding device comprising means for causing said plate springs attached to the lateral surfaces of the shadowmask to be deformed in a manner to move toward the lateral surfaces of the shadowmask; and a shadowmask holding device actuating device for moving the shadowmask holding device upwardly and mounting the shadowmask held thereby in a predetermined position in the panel.

13. Apparatus as claimed in claim 12, wherein said shadowmask holding device actuating device comprises an elevatory plate movable in a substantially vertical direction, a plurality of guide rods for securing the shadowmask holding device on said elevatory plate with a predetermined spacing, and means for moving said elevatory plate in a substantially vertical direction, and wherein said panel holding device comprises a panel holding plate interposed between said elevatory plate and said shadowmask holding device and movable along said guide rods, a plurality of positioning upright portions formed on said panel holding plate and each formed with a notch for receiving one of said panel pins, and means for moving said panel holding plate between a position in which the panel holding plate is disposed in close proximity to said shadowmask holding device with a predetermined spacing therebetween and a position in which the panel holding plate is moved downwardly away from the shadowmask holding device.

14. Apparatus as claimed in claim 13, wherein said means of said shadowmask holding device for causing the plate springs to be deformed comprises four slider each formed at one end thereof with an engaging pawl for sliding movement in a direction at a right angle to one of the sides of the shadowmask, a rotary cam in engagement with said sliders at the other end thereof and adapted to move said engaging pawls of all the sliders simultaneously away from one another when rotated in one direction and move said engaging pawls of all the sliders toward one another when rotated in the reverse direction, and means for rotating said rotary cam.

15. Apparatus for mounting a shadowmask in a panel, said panel including a substantially quadrangular lower opening, four inner lateral surfaces extending upwardly from said lower opening and three panel pins each attached to one of three of said four inner lateral surfaces, and said shadowmask having attached to lateral surfaces thereof corresponding to said panel pins plate springs each formed with an aperture for receiving one of the panel pins, such apparatus comprising:

means comprising a substantially horizontal support surface for movably supporting said panel;

a plurality of positioning units corresponding in number and position to the panel pins of said panel placed on said support means and each including a positioning lever formed therein with a groove for guiding one of said panel pins to a predetermined position for positioning said panel as said positioning lever is actuated while said panel is being held by said support means;

a shadowmask holding device located beneath the said support means for holding the shadowmask, said shadowmask holding device comprising means for causing said plate springs attached to the lateral surfaces of said shadowmask to be deformed in a manner to move toward the lateral surfaces of the shadowmask; and a shadowmask holding device actuating device for moving the shadowmask holding device upwardly and mounting the shadowmask held thereby in a predetermined position in the panel.

16. Apparatus as claimed in claim 15, further comprising a panel holding device for holding and moving upwardly the panel placed on said support surface in such a manner that the panel is located in a predetermined vertical position relative to the shadowmask held by said shadowmask holding device.

17. Apparatus as claimed in claim 15, wherein each of said positioning units comprises an elevatory plate supporting said positioning lever and movable in a substantially vertical direction, means for moving said elevatory plate, means for pivotally connecting said positioning lever to said elevatory plate in such a manner that a rectilinear portion at the forward end of the positioning lever formed with said groove is movable between a position in which said rectilinear portion is disposed substantially vertically beneath the corresponding panel pin of the panel placed in a substantially correct position on said panel support means and a position in which said rectilinear portion is disposed away from beneath said panel, and means for pivotally moving said positioning lever.

* * * * *